US007648400B2

(12) United States Patent
Zhu et al.

(10) Patent No.: US 7,648,400 B2
(45) Date of Patent: Jan. 19, 2010

(54) ELECTRICAL CONNECTOR WITH IMPROVED CONTACTS

(75) Inventors: Zi-Qiang Zhu, Kunshan (CN); Hong-Wu Wang, Kunshan (CN); Hong-Qiang Han, Kunshan (CN); Lun-Song Hu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/384,296

(22) Filed: Apr. 2, 2009

(65) Prior Publication Data

US 2009/0253308 A1 Oct. 8, 2009

(30) Foreign Application Priority Data

Apr. 2, 2008 (CN) ..... 2008 2 0034920 U

(51) Int. Cl.
*H01R 24/04* (2006.01)

(52) U.S. Cl. ..... 439/668; 439/188

(58) Field of Classification Search ..... 439/668, 439/669, 344, 188
See application file for complete search history.

(56) References Cited

U.S. PATENT DOCUMENTS 4,392,708 A 7/1983 Bailey et al.
4,393,283 A 7/1983 Masuda
4,937,404 A 6/1990 Kitagawa
5,893,767 A 4/1999 Broschard
6,077,126 A 6/2000 Peng
6,093,058 A 7/2000 Wu
6,190,205 B1 * 2/2001 Wu ..... 439/607.34
2002/0052148 A1 * 5/2002 Nagata ..... 439/668
2003/0100227 A1 * 5/2003 Yeh ..... 439/668
2008/0076303 A1 * 3/2008 Zhang ..... 439/668

* cited by examiner

*Primary Examiner*—Hien Vu
(74) *Attorney, Agent, or Firm*—Wei Te Chung; Andrew C. Cheng; Ming Chieh Chang

(57) ABSTRACT

An electrical connector (100) including an insulative housing (1) having a front mating face (16), a receiving cavity (10) recessed rearwardly from the front mating face to receive a mating plug and a plurality of passageways; a number of contacts retained in the passageways respectively and including a first contact (21) having a first vertical base portion (210), a first curved portion (218) being curved forwardly from an upper side of the first vertical base portion, a second curved portion (270) and a vertical plate portion (219) connecting with both the first curved portion and the second curved portion, a first contacting arm (211) extending rearwardly from the second curved portion and projecting into the receiving cavity, a first soldering portion (216) connected to a bottom end of the first vertical base portion; both the vertical plate portion (211) and the first contacting arm (211) is deflectable along a direction perpendicular to the plug insertion direction.

10 Claims, 4 Drawing Sheets

ELECTRICAL CONNECTOR WITH IMPROVED CONTACTS

BACKGROUND OF THE INVENTION

1. Field of the Invention

The present invention generally relates to an electrical connector and more particularly to an electrical connector having improved contacts.

2. Description of Related Art

A conventional audio jack is usually used in electrical equipments such as stereo audio equipment, mobile phones and the like for contacting with a mating plug. The audio jack is mounted on a printed circuit board, and comprises an insulative housing defining a front mating face and a receiving cavity recessed rearward from the front mating face, and a plurality of contacts retained in the receiving cavity. The contacts include a vertical base portion retained with the housing, a soldering portion extending laterally from a lower end of the base portion to be soldered onto the printed circuit board, a contacting arm extending from the base portion and projecting into the receiving cavity to contact with the mating plug. However, in order to ensure desirable elasticity of the contacting arm, the contacting arm is configured to have a large length, in this way, the manufacturing cost of the contacts is relatively high, on the other hand, the receiving cavity has to be large to receive the contacting arm, thereby rendering it not beneficial to make the audio jack miniature.

It is thus desired to provide an electrical connector having an improved soldering portion.

SUMMARY OF THE INVENTION

According one aspect of the present invention, an electrical connector to be mounted on a printed circuit board and comprising: an insulative housing having a front mating face, an upper wall, a lower wall, a receiving cavity recessed rearwardly from the front mating face to receive a mating plug and a plurality of passageways; and a plurality of contacts retained in the passageways respectively, including: a first contact having a first vertical base portion extending along a height direction of the housing, a first contacting arm projecting inwardly into the receiving cavity, a connection portion connecting with the first vertical base portion and the first contacting arm, and a first soldering portion connected to a bottom end of the first vertical base portion; wherein the connection portion is disposed between the first vertical base portion and the first contacting arm along a lateral direction of the housing, the connection portion includes a first curved portion being curved forwardly from an upper side of the first vertical base portion, a second curved portion connected to the first contacting arm and a vertical plate portion connecting with both the first curved portion and the second curved portion, both the connection portion and the first contacting arm is deflectable.

According to another aspect of the present invention, an electrical connector to be mounted on a printed circuit board and comprising: an insulative housing having a receiving cavity for receiving a mating plug and a plurality of passageways; and a plurality of contacts retained in the passageways respectively, including: a first contact having a first vertical base portion, a connection portion extending inwardly from the first vertical base portion, a first contacting arm extending inwardly from the connection portion and projecting into the receiving cavity to contact with the mating plug, a first soldering portion connected to a bottom end of the first vertical base portion; the connection portion is disposed between the first vertical base portion and the first contacting arm along a lateral direction of the housing, both the connection portion and the first contacting arm are deflectable along the lateral direction, a first space is formed between the first vertical base portion and the vertical plate portion along a lateral direction, a second space is formed between the first contacting arm and the vertical plate portion, the second space is larger than the first space.

Other objects, advantages and novel features of the present invention will become more apparent from the following detailed description of the present embodiment when taken in conjunction with the accompanying drawings.

DETAILED DESCRIPTION OF THE INVENTION

Figure 1:
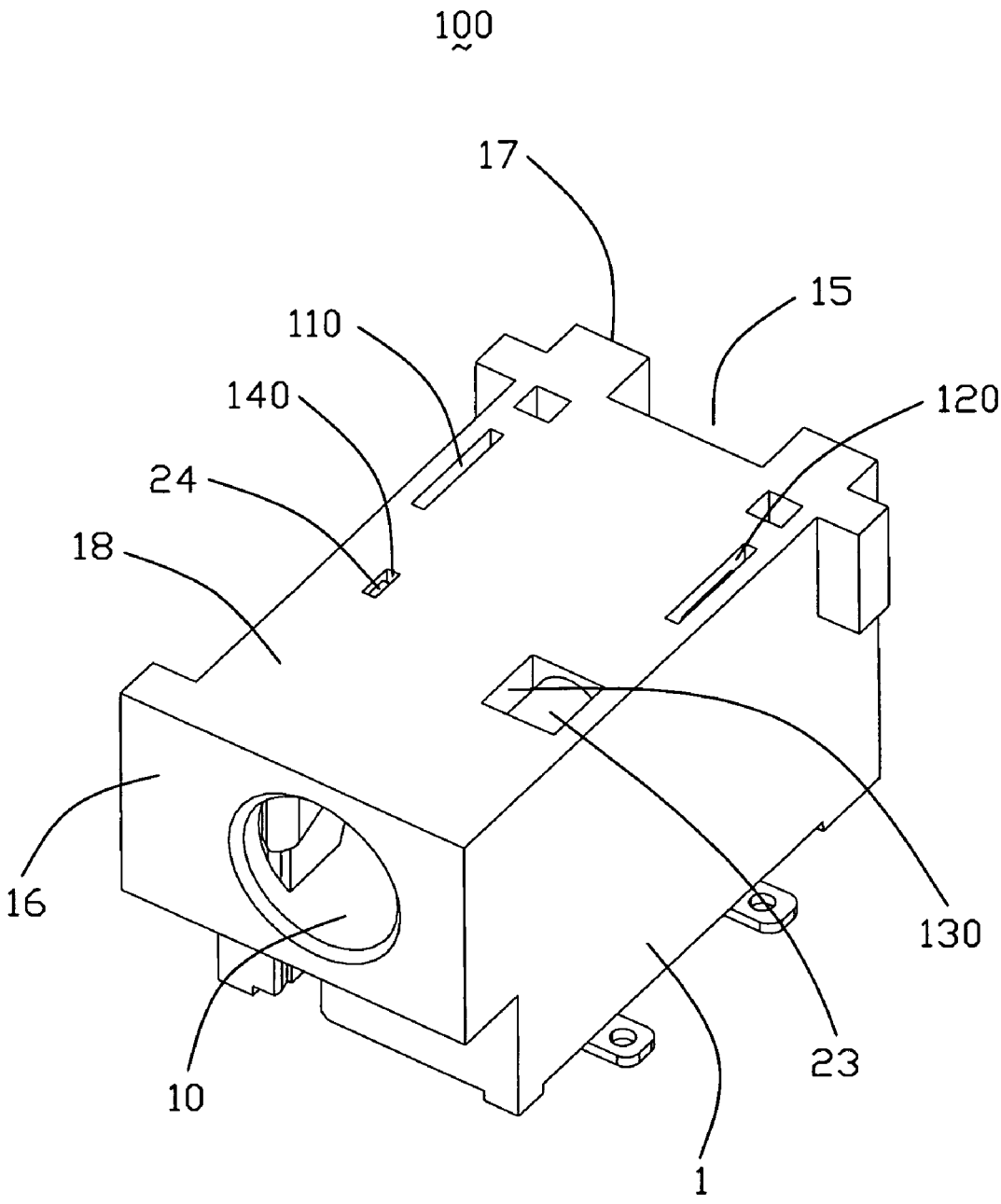
FIG. 1 is an assembled perspective view of an electrical connector according to the present invention.

Reference will now be made to the drawing figures to describe the preferred embodiment of the present invention in detail.

Figure 2:
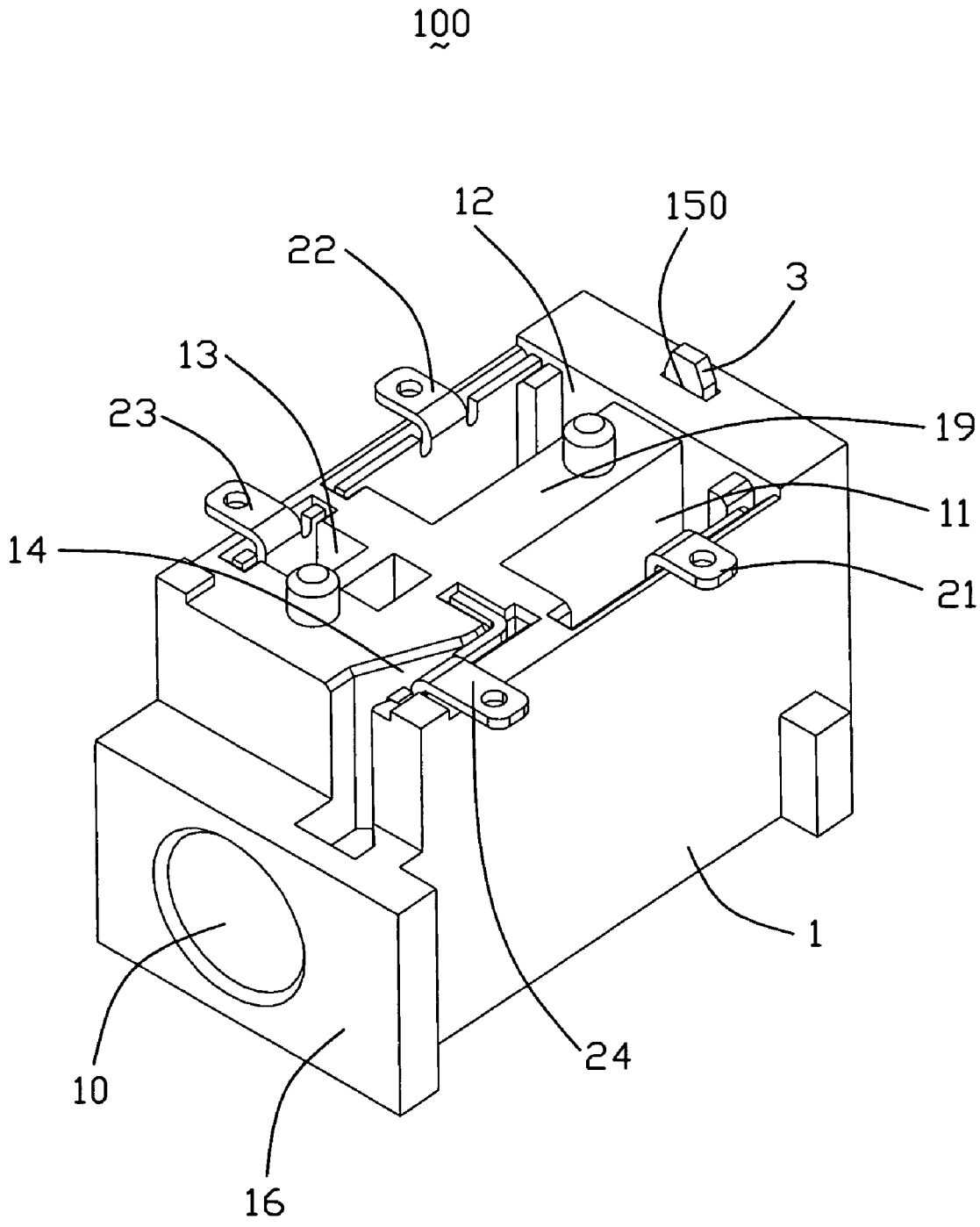
FIG. 2 is a view similar to FIG. 1, while taken from a different aspect.
Figure 3:
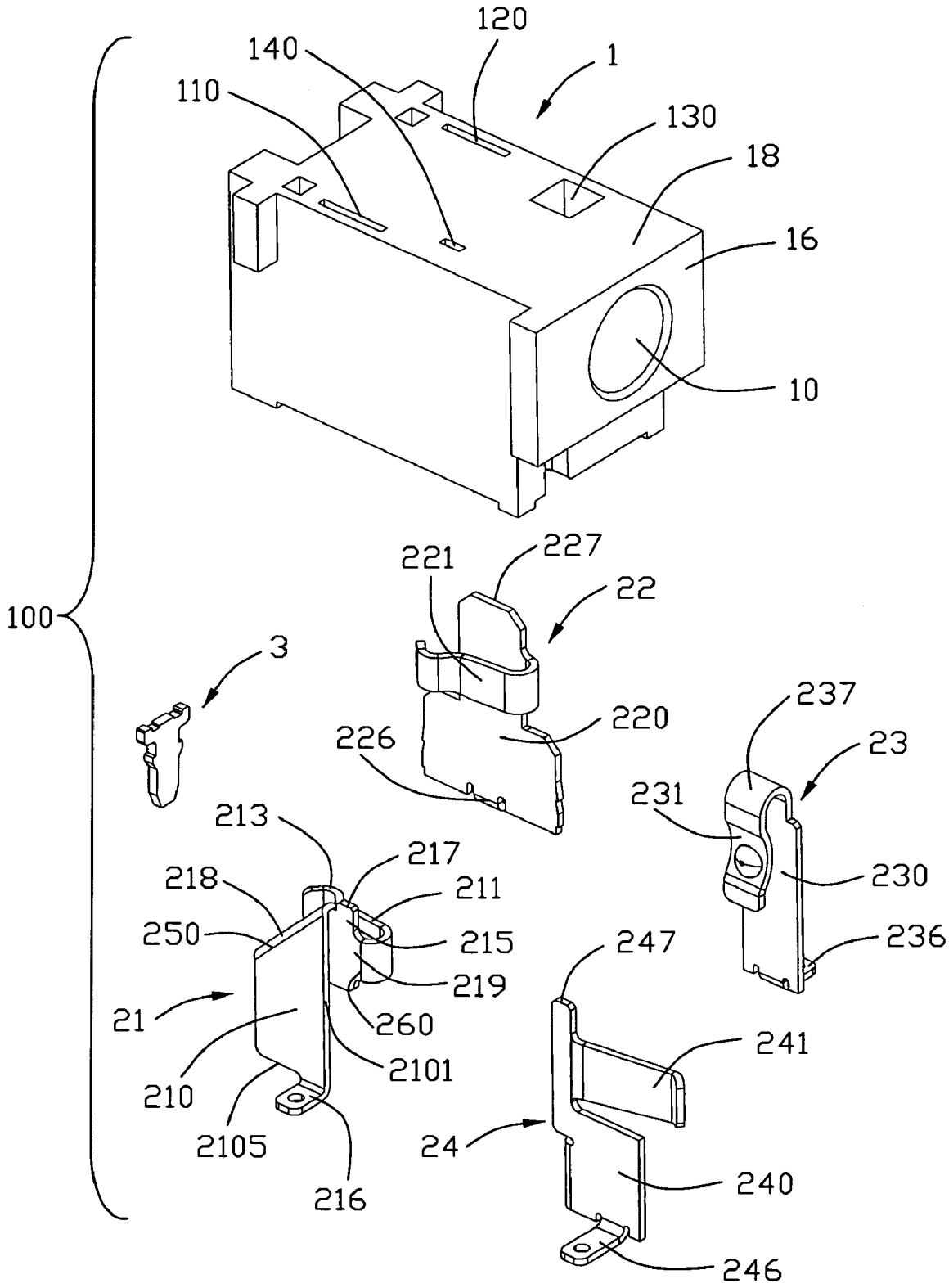
FIG. 3 is an exploded perspective view of the electrical connector shown in FIG. 1.
Figure 4:
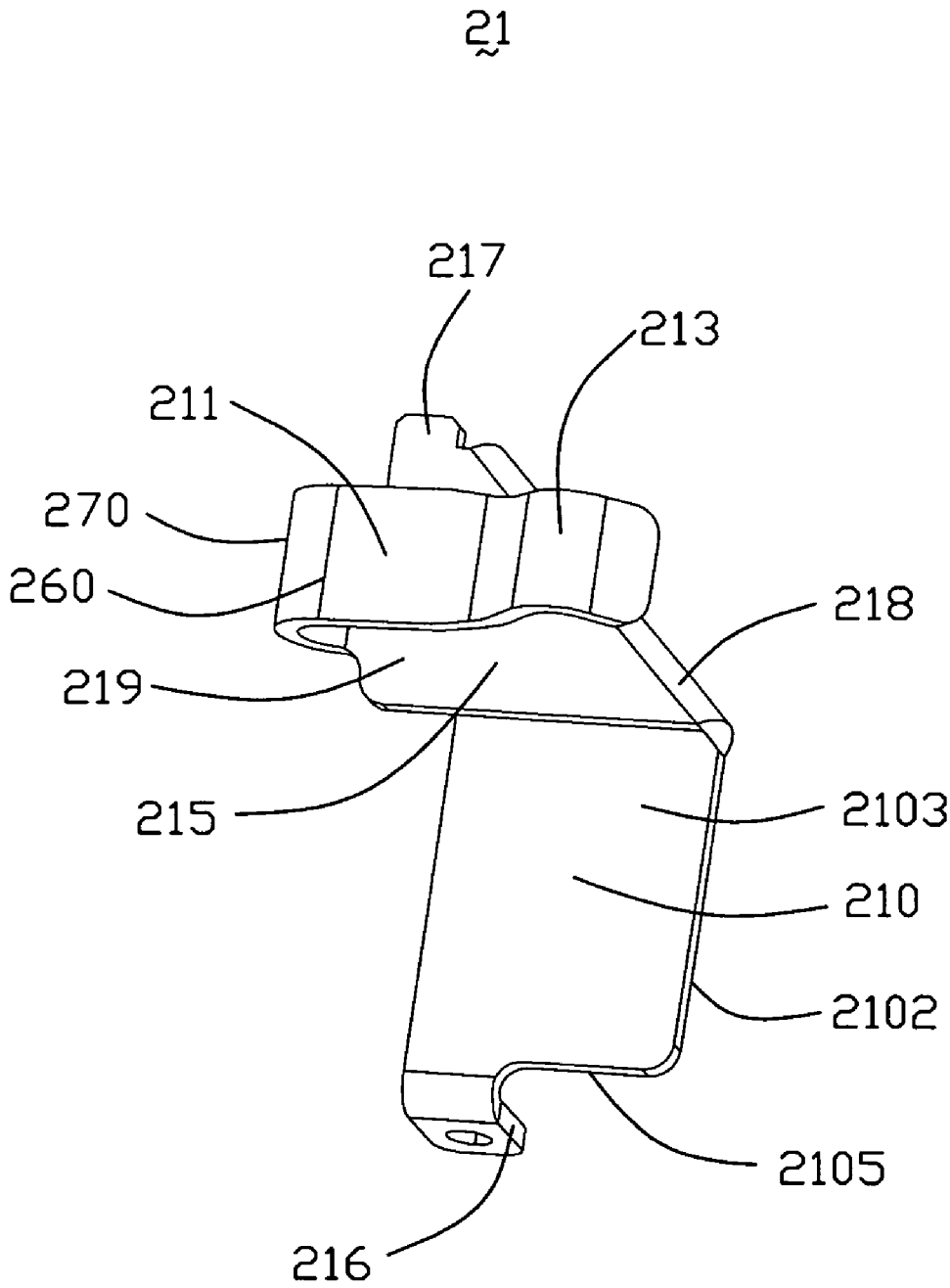
FIG. 4 is a view of a first contact of the electrical connector.

Referring to FIGS. 1, 2 and 3, an electrical connector 100, preferably an audio jack connector, comprises an insulative housing 1, a plurality of electrical contacts and a retaining tab 3 retained on a rear side of the housing 1.

The housing 1 has a rectangular body portion 18, a front mating face 16 and a receiving cavity 10 extending rearwardly through the front mating face 16 for receiving a mating plug (not shown). The body portion 18 has an upper wall, a lower wall opposite to the upper wall, a pair of side walls connecting with both the upper wall and the lower wall. The upper wall is provided with a first through hole cavity 110, a second through hole 120, a third through hole 130, a fourth through hole 140. The through holes 110, 120, 130, 140 extending upwardly through the upper wall and communicating with the receiving cavity 10.

The contacts 2 includes a first contact 21 located on a rear and left side of the body portion 18, a second contact 22 positioned on a rear and right side of the body portion 18, a third contact 23 located on a front side of the second contact 22, a fourth contact 24 disposed on a front side of the first contact 21. The first contact 25 has a first vertical base portion 210 extending along a height direction of the housing 1, a first contacting arm 211 projecting inwardly into the receiving cavity 10, a connection portion 215 connecting with the first vertical base portion 210 and the first contacting arm 211, a first soldering portion 216 connected to a bottom end of the first vertical base portion 210. The connection portion 215 is disposed between the first vertical base portion 210 and the first contacting arm 211 along a lateral direction of the housing 1. The connection portion 215 includes a first curved portion 218 being curved forwardly from an upper side of the first vertical base portion 210, a second curved portion 270 and a vertical plate portion 219 connecting with both the first curved portion 218 and the second curved portion 270. The first contacting arm 211 extends rearwardly from the second curved portion 270. The second curved portion 270 defines a pair of opposite vertical side edges 260 connected to the first contacting arm 211 and the vertical plate portion 219 respectively. The first contacting arm 211 is provided with a contacting portion 213 on a distal end thereof to contact with the mating plug.

Both the first contacting arm 211 and the connection portion 215 are deflectable within the receiving cavity 10 along a direction perpendicular to the plug insertion direction. The first curved portion 218 and the second curved portion 270 are of arc shape. The first vertical base portion 210 is of trapezium shape. And defines a lower side edge 2105, and an upper side edge 250 connecting with the first curved portion 218, the upper side edge 250 is an inclined line extending upwardly and obliquely with respect to the lower side edge 2105.

The vertical plate portion 219 defines a protrusion tab 217 extending upwardly from an upper side thereof, the protrusion tab 217 is adjacent to an upper end of the upper side edge 250. The upper wall 18 defines a first though hole 110 extending therethrough and communicating with the receiving cavity 10, the protrusion tab 217 is fixed in the first through hole 110. A first space is formed between the first vertical base portion 210 and the vertical plate portion 219 along a lateral direction of the housing 1, a second space is formed between the first contacting arm 211 and the vertical plate portion 219, the second space is larger than the first space.

The fourth contact 24 includes a fourth vertical base portion 240, a fourth soldering portion 246 extending from a bottom side of the fourth vertical base portion 240, a vertical tab 247 extending upwardly from a vertical side edge of the fourth vertical base portion 240, a fourth contacting arm 241 projecting forwardly from the vertical tab 247 and extending inwardly into the receiving cavity 10, the fourth contacting arm 241 is deflectable and located above fourth vertical base portion 240 along a height direction of the fourth contact 24, the fourth contacting arm 241 is located on an inner side of the fourth vertical base portion 240. The upper wall defines a fourth through hole 140, the vertical tab 247 defines an upper end retained in the fourth through hole 140.

The third contact 23 includes a third vertical base portion 230, a third soldering portion 236 extending laterally from a bottom side of the third vertical base portion 230, a curved tab 237 extending upwardly and the downwardly from the third vertical base portion 230, a third contacting arm 231 projecting downwardly from the curved tab 237 and extending inwardly into the receiving cavity 10, the third contacting arm 231 is deflectable, the third contacting arm 231 is located on an inner side of the third vertical base portion 230. The upper wall defines a third through hole 130, the curved tab 237 defines an upper end retained in the third through hole 130.

The second contact 22 includes a second vertical base portion 220, a second soldering portion 226 extending laterally from a bottom side of the second vertical base portion 220, a vertical tab 227 extending upwardly from the second vertical base portion 220, a second contacting arm 221 projecting forwardly from a vertical side edge of the vertical tab 227 and extending inwardly into the receiving cavity 10, the second contacting arm 221 is deflectable and located above second vertical base portion 220 along a height direction of the second contact 22, the second contacting arm 221 is located on an inner side of the second vertical base portion 220. The upper wall defines a second through hole 120, the vertical tab 227 defines an upper end retained in the second through hole 120.

The retaining tab 3 is positioned on a rear side of the receiving cavity 10 to abut against a front end of the mating plug, the lower wall defines a retaining hole 150 extending therethrough, the retaining tab 3 is fixed in the retaining hole 150 and extends beyond the lower wall to be mounted onto a PCB.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector to be mounted on a printed circuit board, comprising:

an insulative housing having a front mating face, an upper wall, a lower wall, a receiving cavity recessed rearwardly from the front mating face to receive a mating plug and a plurality of passageways; and a plurality of contacts retained in the passageways respectively, including:

a first contact having a first vertical base portion extending along a height direction of the housing, a first contacting arm projecting inwardly into the receiving cavity, a connection portion connecting with the first vertical base portion and the first contacting arm, and a first soldering portion connected to a bottom end of the first vertical base portion;

wherein the connection portion is disposed between the first vertical base portion and the first contacting arm along a lateral direction of the housing, the connection portion includes a first curved portion being curved forwardly from an upper side of the first vertical base portion, a second curved portion connected to the first contacting arm and a vertical plate portion connecting with both the first curved portion and the second curved portion, both the connection portion and the first contacting arm is deflectable;

wherein the lower wall defining a retaining hole extending therethrough, the retaining tab is fixed in the retaining hole and extends beyond the lower wall to be mounted onto the printed circuit board;

wherein the first vertical base portion defines a lower side edge, and an upper side edge connecting with the first curved portion, the upper side edge extends upwardly and obliquely with respect to the lower side edge;

wherein the first vertical base portion is of trapezium shape, the first contacting arm extends rearwardly from the second curved portion, the second curved portion defines a pair of opposite vertical side edges connected to the first contacting arm and the vertical plate portion respectively; and wherein the first vertical plate portion defines a protrusion tab extending upwardly from an upper side thereof, the protrusion tab is adjacent to an upper end of the upper side edge, the upper wall defines a first though hole extending therethrough and communicating with the receiving cavity, the protrusion tab is fixed in the first through hole.

2. The electrical connector as claimed in claim 1, wherein the lower wall defining a retaining hole extending therethrough, the retaining tab is fixed in the retaining hole and extends beyond the lower wall to be mounted onto the printed circuit board.

3. The electrical connector as claimed in claim 1, wherein both the first curved portion and the second curved portion are of arc shape.

4. The electrical connector as claimed in claim 1, wherein the contacts further comprise a second contact, a third contact and a fourth contact, the second contact, the third contact and the fourth contact extending inwardly into the receiving cavity.

5. The electrical connector as claimed in claim 4, wherein the fourth contact includes a fourth vertical base portion, a fourth soldering portion extending from a bottom side of the fourth vertical base portion, a vertical tab extending upwardly from the fourth vertical base portion, a fourth contacting arm projecting forwardly from the vertical tab and extending into the receiving cavity, the fourth contacting arm is deflectable and located above fourth vertical base portion along a height direction of the fourth contact, the fourth contacting arm is located on an inner side of the fourth vertical base portion.

6. The electrical connector as claimed in claim 5, wherein the upper wall defines a fourth through hole, the vertical tab defines an upper end retained in the fourth through hole.

7. An electrical connector to be mounted on a printed circuit board, comprising:

an insulative housing having a receiving cavity for receiving a mating plug and a plurality of passageways; and a plurality of contacts retained in the passageways respectively, including:

a first contact having a first vertical base portion, a connection portion extending inwardly from the first vertical base portion, a first contacting arm extending inwardly from the connection portion and projecting into the receiving cavity to contact with the mating plug, a first soldering portion connected to a bottom end of the first vertical base portion; the connection portion is disposed between the first vertical base portion and the first contacting arm along a lateral direction of the housing, both the connection portion and the first contacting arm are deflectable along the lateral direction, a first space is formed between the first vertical base portion and the vertical plate portion along a lateral direction, a second space is formed between the first contacting arm and the vertical plate portion, the second space is larger than the first space;

wherein the upper wall defines a fourth through hole, the vertical tab defines an upper end retained in the fourth through hole;

wherein the connection portion defines a first curved portion being curved forwardly from an upper side of the first vertical base portion, a second curved portion and a vertical plate portion connecting with both the first curved portion and the second curved portion, the first contacting arm extends rearwardly from the second curved portion;

wherein the vertical plate portion defines a protrusion tab extending upwardly from an upper side thereof, the protrusion tab is adjacent to an upper end of the upper side edge, the upper wall defines a first though hole extending therethrough and communicating with the receiving cavity, the protrusion tab is fixed in the first through hole; and wherein the lower wall defining a retaining hole extending therethrough, the retaining tab is fixed in the retaining hole and extends beyond the lower wall to be mounted onto the printed circuit board.

8. An electrical connector to be mounted on a printed circuit board comprising:

an insulative housing defining a plug receiving cavity extending along an axial direction thereof;

a plurality of contact receiving passageways extending upwardly from a bottom face of the housing and communicating with the plug receiving cavity under condition that some of said contact receiving passageways extend through a top face of the housing which is opposite to the bottom face;

a plurality of contacts disposed in the corresponding contact receiving passageways, respectively; wherein a first one of said contacts defines a horizontally lying U-shaped contacting section included a triangular vertical plate section in an inner side and an upstanding mounting section on an outer side under condition that said U-shaped contact section and said upstanding mounting section formed of a trapezium shape and a soldering portion connecting with a bottom end of the trapezium shape linked via a curved edge region which extends along an oblique direction in a side view so that said one of the contacts essentially extends along a longitudinal direction in an extended manner on a raw metal sheet before forming for consideration of saving material;

wherein the bottom face defining a retaining hole extending therethrough, the retaining tab is fixed in the retaining hole and extends beyond the bottom face to be mounted onto the printed circuit board;

wherein said oblique direction is around 45 degrees; and wherein said contacting section defines a tab upwardly extending into the top face.

9. The electrical connector as claimed in claim 8, wherein said first one of the contacts defines a rearward contacting beam for engagement with an inserted plug while a second one of said contacts defines a forward contacting beam under condition that said one of the contacts is located behind said another of the contacts.

10. The electrical connector as claimed in claim 9, further including a third one of the contacts defining a downward contacting beam.

* * * * *